US007347720B2

(12) United States Patent
Takashita

(10) Patent No.: US 7,347,720 B2
(45) Date of Patent: Mar. 25, 2008

(54) FLAT CABLE ELECTRICAL CONNECTOR

(75) Inventor: Yoshinori Takashita, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 11/498,200

(22) Filed: Aug. 3, 2006

(65) Prior Publication Data

US 2007/0032115 A1 Feb. 8, 2007

(30) Foreign Application Priority Data

Aug. 8, 2005 (JP) ..... 2005-229149

(51) Int. Cl.
*H01R 12/24* (2006.01)

(52) U.S. Cl. ..... 439/495; 439/260

(58) Field of Classification Search ..... 439/492–496, 439/260

See application file for complete search history.

(56) References Cited

U.S. PATENT DOCUMENTS 7,044,773 B2 * 5/2006 Suzuki et al. ..... 439/495
7,083,454 B2 * 8/2006 Suzuki ..... 439/260
7,094,093 B2 * 8/2006 Nakano et al. ..... 439/495
7,189,104 B1 * 3/2007 Gillespie et al. ..... 439/495

FOREIGN PATENT DOCUMENTS

JP 3047862 3/2000

* cited by examiner

*Primary Examiner*—Truc T. Nguyen
*Assistant Examiner*—X. Chung-Trans
(74) *Attorney, Agent, or Firm*—Kubotera & Associates, LLC

(57) ABSTRACT

When the movable member (30) is at the open position, the cam portion (33) of the movable member (30) is out of contact with the pressure receiving portion of a lever arm (21), making it possible to insert a flat cable into the connector on the contact side. When the movable member (30) is at the closed position, the cam portion (33) comes into contact with the pressure receiving portion that consists of a shoulder (21D) and a concave indentation (21B). While the movable member (30) is moving to the closed position, the cam portion (33) pushes the shoulder (21D) to provide the pressure receiving portion with the highest pressure. When the movable member (30) reaches the closed position, the cam portion (33) rests in the concave indentation (21B) while maintaining a pressure less than the highest pressure.

12 Claims, 5 Drawing Sheets

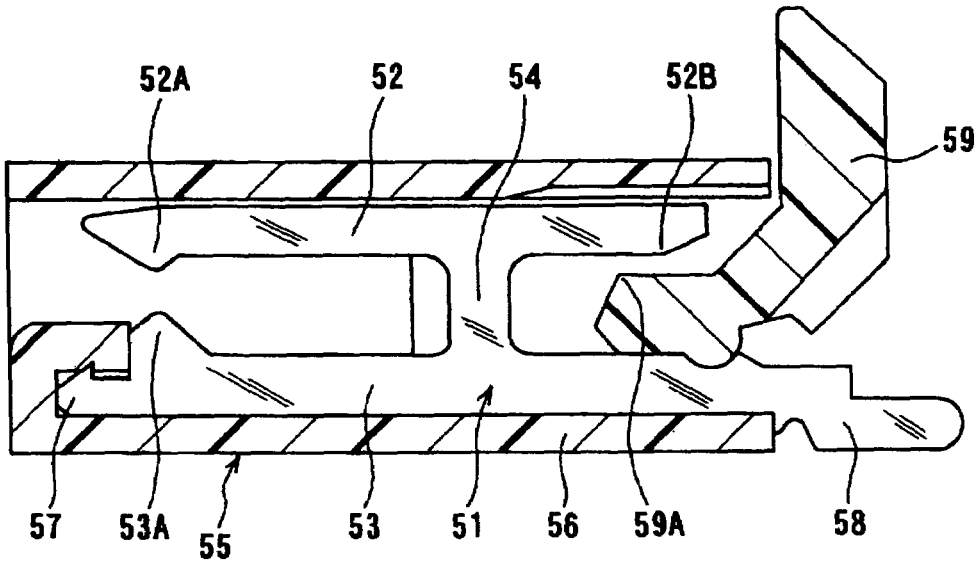
FIG. 5 (A) PRIOR ART
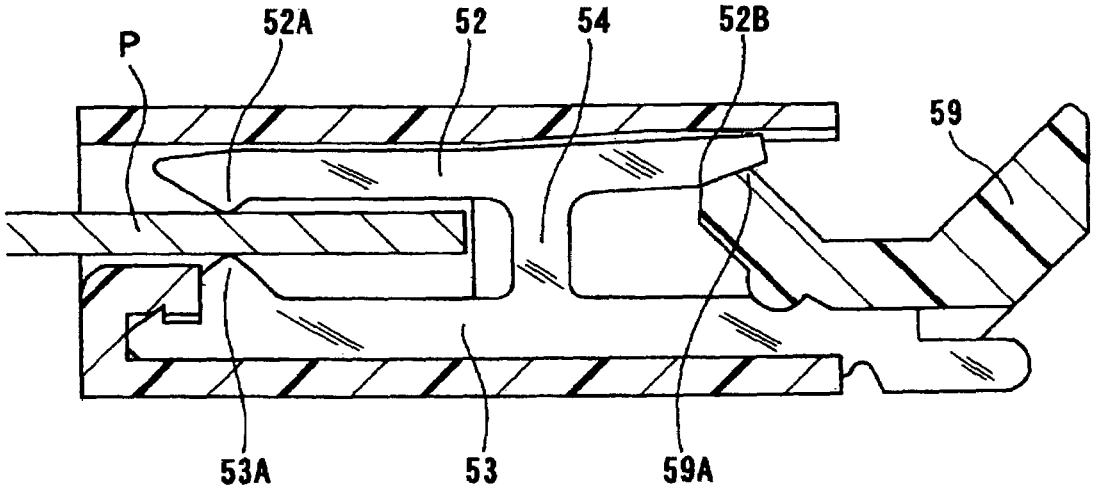
FIG. 5 (B) PRIOR ART

FLAT CABLE ELECTRICAL CONNECTOR

BACKGROUND OF THE INVENTION

1. Field of the Invention

The present invention relates to electrical connectors for flat cables.

2. Description of the Related Art

Japanese Patent No. 3047862 discloses a connector of this type. As shown in FIGS. 5(A) and 5(B), this connector includes a plurality of terminals 51 arranged in the direction perpendicular to the drawing sheet. The terminal 51 has upper and lower arms 52 and 53 which are connected by a linking section 54, forming a substantially H-shape. The lower arm 53 is in contact with the bottom wall 56 of a housing 55, with one of its ends 57 engaged with the housing 55. The other end forms a connection section 58 outside the housing 55. The upper arm 52 is made flexible and has a contact portion 52A at one end to cooperate with the contact portion 53A of the lower arm 53 for holding a flat cable P between them for contact. See FIG. 5(B). At the other end, it has a corner portion 52B to receive a force from a movable member 59 when the movable member 59 rotates from the position of FIG. 5(A) to the position of FIG. 5(B). Consequently, the contact portion 52A is pressed onto the flat cable P.

The movable member 59 has a corner portion 59A to serve as a cam for the corner portion 52B. When the corner portion 59A moves past the corner portion 52B, it makes a click sound and presses the upper arm 52 to keep the contact pressure of the contact portion 52A.

There is a demand for a low-profile connector of this type. Also, it is required to provide a sufficient click sound or sensation to indicate that the movable member is brought to such a position that a satisfactory contact pressure is provided between the terminal and the flat cable.

However, the above connector fails to meet both the requirements at the same time.

The degree of click sensation is large when the angle between the two straight sections of the corner portion 52B is large because the contact position with the movable member changes quickly. However, if the angle is too large, no low-profile connector is provided. Also, when the movable member 59 moves past the corner portion 52B, the upward pressure is lowered too quickly to provide satisfactory contact pressure between the contact portion 52A and the flat cable. In other words, when the satisfactory contact pressure is maintained, the angle of the corner portion is too small to provide a satisfactory click sensation.

SUMMARY OF THE INVENTION

Accordingly, it is an object of the present invention to provide a low-profile flat cable electrical connector capable of providing a satisfactory click sensation and maintaining a high contact pressure between the terminal and the flat cable.

The invention relates to a flat cable electrical connector, which includes a housing; a plurality of terminals made of sheet metal and arranged in the housing at predetermined intervals in a first direction perpendicular to the sheet metal; and a movable member rotatable between an open position and a closed position and having a cam portion. Each of the terminals includes a lever arm extending in a second direction in which a flat cable is inserted into the electrical connector and having a fulcrum at a middle point thereof. The lever arm has a pressure projection for pressing down the flat cable at an end thereof and a pressure receiving portion at the other end for receiving a pressure from the cam portion of the movable member to flex in the same plane as that of said terminal, thereby producing a pressure between the contact projection and the flat cable.

The cam portion has such a shape that it is out of contact with the pressure receiving portion of the lever arm when the movable member is at the open position, thereby making it possible to insert the flat cable and in contact with the pressure receiving portion when the movable member is at the closed position. The pressure receiving portion has a shoulder and a concave indentation continued from the shoulder so that when the movable member moves to the closed position, the cam portion provides the pressure receiving portion with a highest pressure and when the movable member reaches the closed position, the cam portion rests in the concave indentation while maintaining a pressure that is lower than the highest pressure.

When the cam portion reaches the shoulder of the pressure receiving portion, the lever arm receives the highest pressure from the cam portion. A large degree of click sensation is provided at the entry of the concave indentation due to the sharp slope of the concave indentation. At the closed position of the moving member, the cam portion abuts against the upward slope of the concave indentation, maintaining a high pressure on the pressure receiving portion.

The cam portion may have an elongated circular or elliptic cross-section and the concave indentation may have such a curved shape as to fit to a shape of said cam portion. The curved portion of the elongated circular or ecliptic cam makes the contact position with the pressure receiving portion move smoothly and the concave curve of the concave indentation makes stable the final position of the cam at the closed position.

The terminal further comprises an attaching arm extending in parallel with said lever arm and a linking section for connecting said lever and attaching arms at their middle point where said fulcrum is situated. It is preferred that the attaching arm has an attaching section to be attached to said housing adjacent to said linking section.

When the movable member moves to the closed position, the pressure receiving portion of the lever arm receives a force from the cam portion of the movable member so that the linking section receives a large bending moment which is secured by the attaching section.

The housing has a bottom wall, an upper wall and an island provided between said bottom and upper walls to form a space between said bottom wall and said island into which said attaching section is press fitted. Consequently, the attaching section is secured without increasing the height of the connector. The island may be provided near the linking section.

The attaching arm may have a contact projection at a position corresponding to the pressure projection of the lever arm. Also, it may have a connection section projecting from the housing, such that when the connector is provided on a circuit board, the connection section comes into contact with a circuit trace of the circuit board.

As has been described above, according to the invention, the sharp slop of the pressure receiving portion from the shoulder to the front edge of the concave indentation produces a large degree of click sensation. In addition, the movable member abuts against the upward slope at the rear portion of the concave indentation and rests at a stable position while maintaining a large degree of pressure to the pressure receiving portion.

BRIEF DESCRIPTION OF THE DRAWINGS

FIG. 5(A) is a sectional view of a conventional connector, in which the movable member is at the open position; and FIG. 5(B) is a sectional view of the conventional connector, in which the movable member is at the closed position.

DESCRIPTION OF THE PREFERRED EMBODIMENTS

An embodiment of the invention will now be described with reference to FIGS. 1-4.

Figure 1:
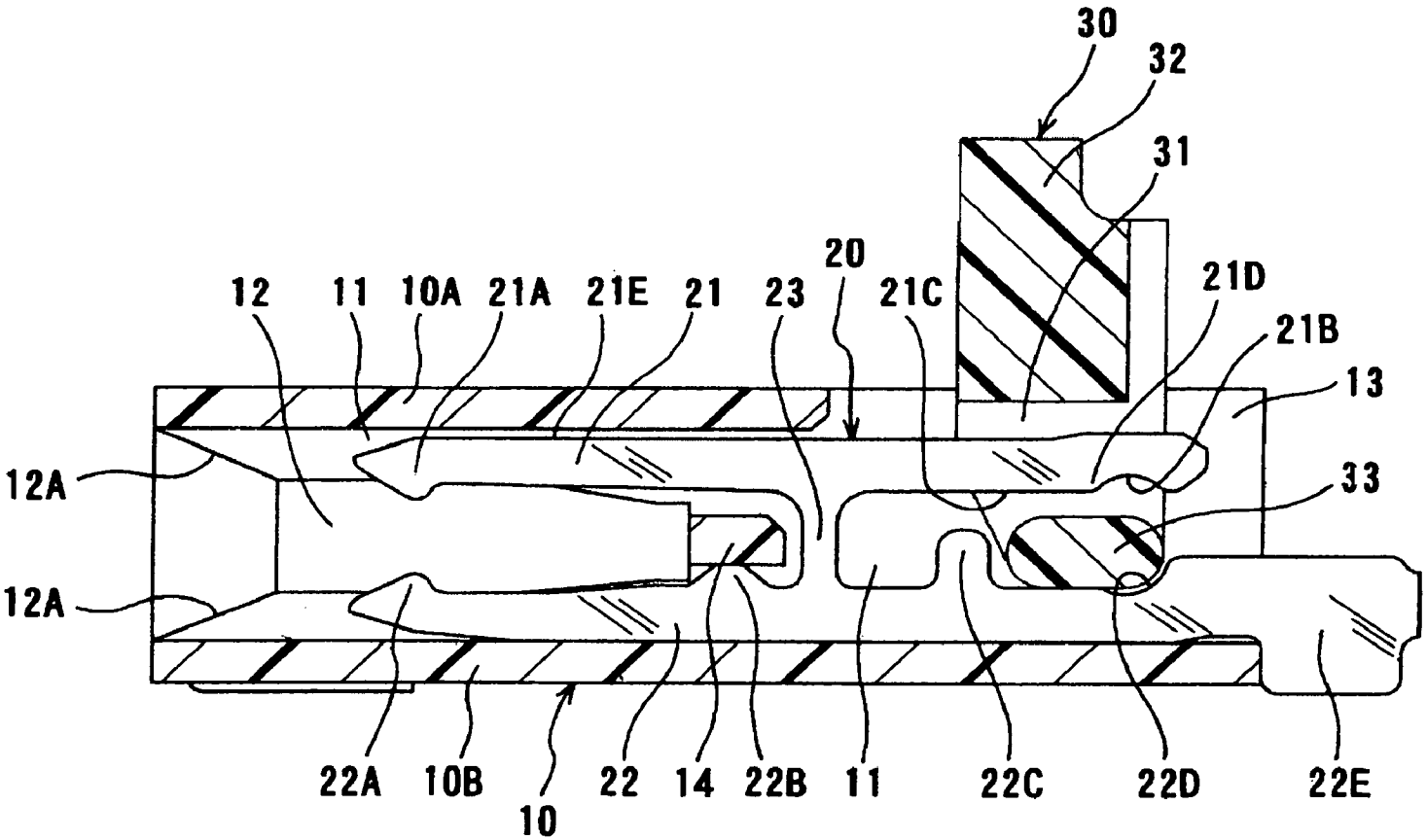
FIG. 1 is a sectional view of an electrical connector according to an embodiment of the invention, in which the movable member is at the open position.

In FIG. 1, a plurality of terminals are arranged at predetermined intervals in the first direction perpendicular to the drawing sheet. A housing 10 is made of a dielectric material so as to provide a substantially rectangular form which has a plurality of slits 11 between an upper wall 10A and a bottom wall 10B of the housing 10 for receiving the terminals. The thickness of the slit 11 is substantially equal to the thickness of the terminal which is inserted into the housing from right to left. The slits 11 are arranged at predetermined intervals in the first direction and extend laterally through the housing 10.

A cable receiving cavity 12 is provided in the left half of the housing 10 so as to communicate with the slits 11. The height of the cable receiving cavity 12 is slightly greater than the thickness of a flat cable to be inserted. The cable receiving cavity 12 has tapered opening 12A to facilitate the insertion of a cable. An open section 13 is provided in the upper right side half of the housing 10 so as to communicate with the slits 11 and receive a movable member. An island 14 is provided in the slit 11 between the upper wall 10A and the bottom wall 10B to link opposite inner walls of the slit 11.

The terminal 20, which is to be inserted into the housing 10, is made so as to maintain the flat surfaces of metal sheet. As shown in FIG. 1, it has an upper lever arm 21 and a lower attaching arm 22. Both the lever arm 21 and the attaching arm 22 extend laterally in substantially parallel and are housed in the upper and lower portions of the slit 11, respectively, and connected with a linking section 23 at the middle position.

The lever arm 21 has a pressure projection 21A at the left end and a curved indentation 21B on the right side lower edge. A shoulder 21D is provided between the curved indentation 21B and a straight edge 21C to form, together with the curved indentation 21B, a pressure receiving portion for receiving a pressure from a cam portion. It is noted that there is a space between the upper edge 21E of the lever arm 21 and the upper wall 10A of the housing 10.

Similarly, the attaching arm 22 has a contact projection 22A at the left end at a position corresponding to the pressure projection 21A. A pedestal-shaped fixing portion 22B is provided to the left of the linking section 23, which is press fitted into a space of the slit 11 between the island 14 and the bottom wall 10B of the housing 10.

The attaching arm 22 has a stopper projection 22C, a concave indentation 22D, and a connection section 22E to the right of the linking section 23. The concave indentation 22D has an arc shape and is situated at a position corresponding to the concave indentation 21B of the lever arm 21. The connection section 22E has a lower edge that is slightly lower than the bottom wall 10B of the housing 10 and, when the connector is mounted on the circuit board, soldered to the circuit trace.

The movable member 30 is made of a dielectric material so as to extend in the first direction in substantially the same range as the housing 10. It has a plurality of slits 31, an upper manipulation section 32, and a lower cam section 33. It is made rotatable between the open position in FIG. 1 and the closed position in FIG. 3. It is assembled with the housing 10 such that the slit 31 receives the right section of the lever arm 21 while the cam portion 33 is abutted on the upper edge of the attaching arm 22 such that its left portion is adjacent to the stopper portion 22C and its right portion is over the concave indentation 22D of the attaching arm 22. The major diameter of the cam portion 33 is made greater than the distance between the concave indentations 21B and 22D of a terminal 20.

The connector according to the invention is assembled and used as follows.

(1) The terminals 20 are incorporated in the housing 20. Each terminal 20 is inserted into the slit 11 from right to left. The attaching section 22B is press fitted into a space between the bottom wall 10B and the island 14 while the front edge of the connection section 22E abuts against the rear end of the housing 10 so that the terminal 20 is secured at a predetermined position.

(2) The movable member 30 is assembled such that it stands uprightly at the open position in FIG. 1. It is moved to the left such that the rear portion of the lever arm 21 enters the slit 31 thereof. Consequently, the cam portion 33 is housed in the concave indentation made between the stopper portion 22C and the concave indentation 22D. This completes the assembling of the connector.

(3) In use, the connector is provided above a predetermined circuit board (not shown). The connection section 22E is soldered to the corresponding circuit trace while the housing is attached to the circuit board with screws or reinforcing fasteners.

Figure 2:
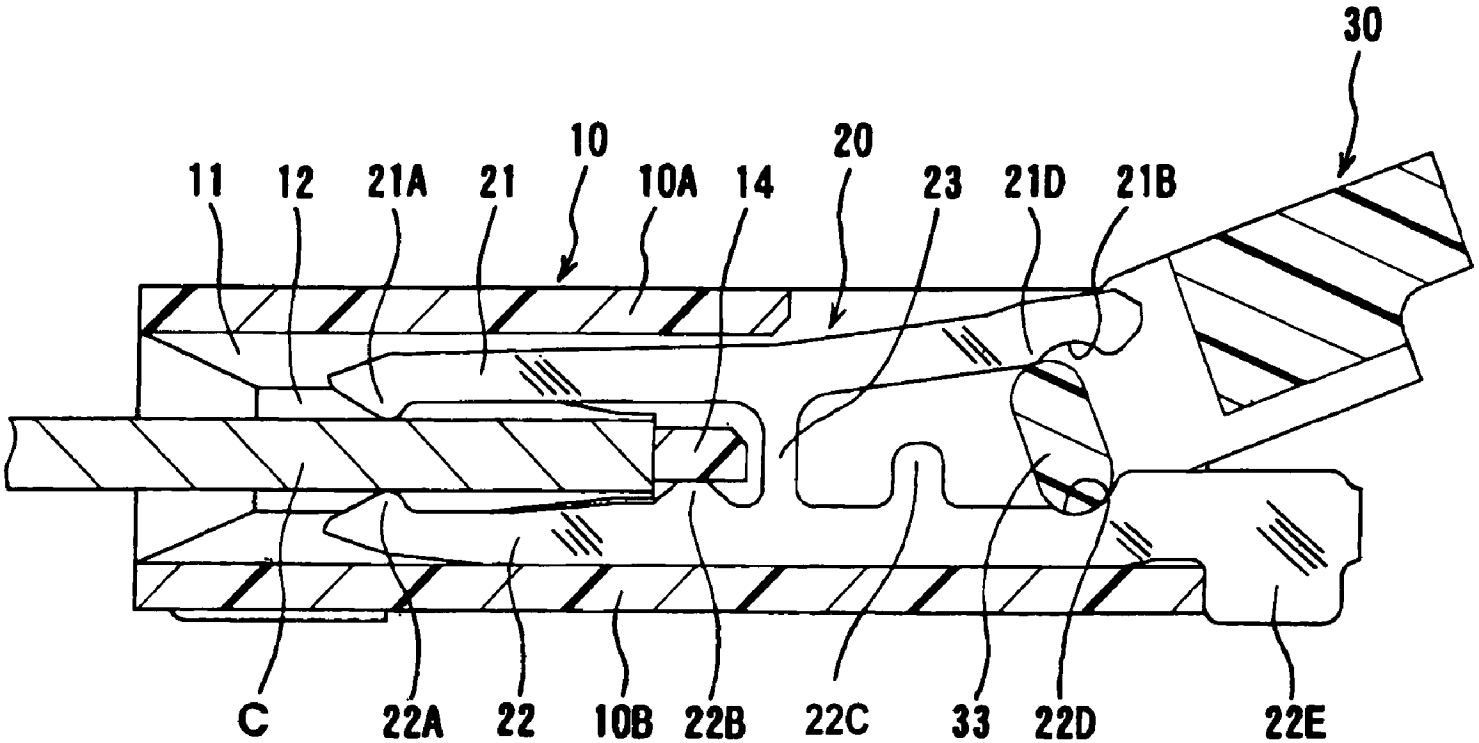
FIG. 2 is a sectional view of the electrical connector, in which the movable member is moving from the open position to the closed position.

(4) A flat cable C or flexible board is inserted into the cavity 12 and, then, as shown in FIG. 2, the movable member 30 is rotated in the clockwise direction. As a result, the cam portion 33 is changed from the horizontal position in FIG. 1 to the vertical position in FIG. 2, so that the terminal 20 is pressed upwardly at the shoulder 21D of the pressure receiving portion to flex upwardly the right side portion of the lever arm 21 on the right side of the linking section 23. Consequently, the left side portion of the lever arm 21 is flexed downwardly with the linking section 23 as a fulcrum. Thus, the flat cable C is pressed downwardly by the pressure projection 21A of the lever arm 21 so that it is held between the pressure projection 21A and the contact section 22A of the attaching arm 22. As a result, the flat cable C is connected electrically with the terminal through the contact projection 22A and/or the pressure projection 21A.

(5) The pressure on the pressure receiving portion of the terminal 20 becomes the highest where the cam portion 33 abuts against the shoulder 21D made by the lower straight edge of the lever arm 21 and the concave indentation 21B.

Figure 3:
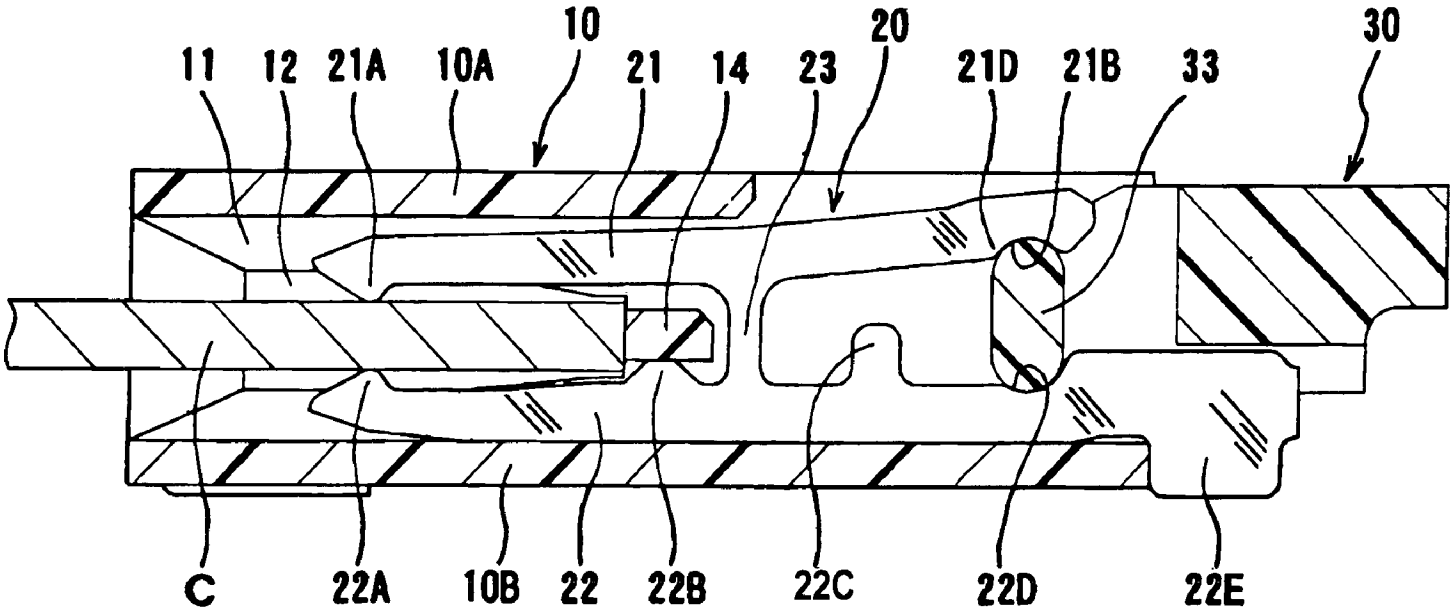
FIG. 3 is a sectional view of the electrical connector, in which the movable member is at the closed position.

(6) When the movable member 30 is further rotated, as shown in FIG. 3, the cam portion 33 rests in the concave indentation 21B past the shoulder 21D. The pressure on the terminal abruptly drops at the entry side of the concave indentation 21B due to the sharp slope so that the operator receives a high degree of clicking sensation. When the cam portion 33 is housed in the concave indentation 21B, the satisfactory pressure on the flat cable C is maintained. The cam portion 33 is stable in the concave indentation 21B so that the movable member 30 will not come off by an accidental force. The movement to the left is restricted by the stopper section 22C.

Figure 4:
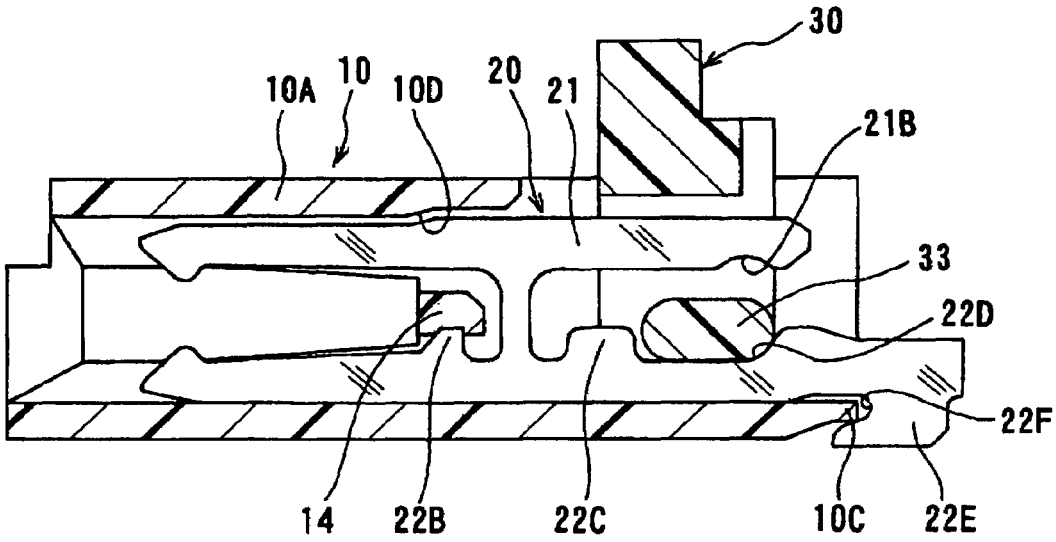
FIG. 4 is a section view of an electrical connector according to another embodiment of the invention.

(7) Various modifications may be made to the invention. For example, as shown in FIG. 4, the concave indentation 22D is connected to the straight section without making any shoulder as in FIG. 1. The cam portion 33 is prevented from coming off to the right by the concave indentation 22D. The bottom edge 10C of the housing is press fitted into the attaching recess 22F of the connection section 22E to assure the attachment of the terminal to the housing. Also, this facilitates soldering the connection section 22E at the predetermined position. When the terminal 20 is press fitted into the housing 10, the lever arm 21 is guided by the tapered section 10D of the upper wall 10A.

The invention claimed is:

1. A flat cable electrical connector, comprising:

a housing;

a plurality of terminals made of sheet metal and arranged in said housing at predetermined intervals in a first direction perpendicular to said sheet metal; and a movable member rotatable between an open position and a closed position and having a cam portion, each of said terminals including a contact projection, a lever arm extending in a second direction in which a flat cable is inserted into said electrical connector and having a fulcrum at a middle point thereof, and an attaching arm extending in parallel with the lever arm and having a first concave indentation;

said lever arm having a pressure projection for pressing down said flat cable at an end thereof and a pressure receiving portion at the other end for receiving a pressure from said cam portion of said movable member to flex in the same plane as that of said terminal, thereby producing a pressure between said contact projection and said flat cable;

said cam portion having such a shape that the cam portion is out of contact with said pressure receiving portion of said lever arm when said movable member is at said open position, thereby making it possible to insert said flat cable and in contact with said pressure receiving portion when said movable member is at said closed position;

said pressure receiving portion having a shoulder and a second concave indentation continued from said shoulder so that when said movable member moves to said closed position, said cam portion provides said pressure receiving portion with a highest pressure and when the movable member reaches said closed position, said cam portion rests between the first concave indentation and the second concave indentation while maintaining a pressure that is lower than said highest pressure.

2. The flat cable electrical connector according to claim 1, wherein said cam portion has an elongated circular or elliptic cross-section and said first concave indentation and said second concave indentation have such a curved shape as to fit to a shape of said cam portion.

3. The flat cable electrical connector according to claim 1, wherein said terminal further comprises a linking section for connecting said the lever arm and the attaching arm at a middle point thereof where said fulcrum is situated.

4. The flat cable electrical connector according to claim 3, wherein said attaching arm has an attaching section to be attached to said housing adjacent to said linking section.

5. The flat cable electrical connector according to claim 4, wherein said housing has a bottom wall, an upper wall and an island provided between said bottom and upper walls to form a space between said bottom wall and said island into which said attaching section is press fitted.

6. The flat cable electrical connector according to claim 3, wherein said attaching arm has a contact projection at a position corresponding to said pressure projection of said lever arm.

7. The flat cable electrical connector according to one of claim 3, wherein said attaching arm has a connection section projecting from said housing, such that when said connector is provided on a circuit board, said connection section comes into contact with a circuit trace of said circuit board.

8. The flat cable electrical connector according to claim 4, wherein said attaching arm has a contact projection at a position corresponding to said pressure projection of said lever arm.

9. The flat cable electrical connector according to claim 1, wherein said attaching arm has a connection section projecting from said housing, such that when said connector is provided on a circuit board, said connection section comes into contact with a circuit trace of said circuit board.

10. The flat cable electrical connector according to claim 6, wherein said attaching arm has a connection section projecting from said housing, such that when said connector is provided on a circuit board, said connection section comes into contact with a circuit trace of said circuit board.

11. The flat cable electrical connector according to claim 1, wherein said first concave indentation is formed in a semi-circular indentation having a linear portion and a curved portion.

12. The flat cable electrical connector according to claim 3, wherein said attaching arm further includes a stopper disposed between the first concave indentation and the linking section.

* * * * *